United States Patent [19]

Bucher

[11] 4,116,242

[45] Sep. 26, 1978

[54] JACQUARD MACHINE HAVING MEANS FOR CONTROLLING JACQUARD NEEDLE MOTION

[75] Inventor: Robert Bucher, Frick, Switzerland

[73] Assignee: Sulzer Brothers Limited, Winterthur, Switzerland

[21] Appl. No.: 748,515

[22] Filed: Dec. 8, 1976

[30] Foreign Application Priority Data

Dec. 19, 1975 [CH] Switzerland ..... 16482/75

[51] Int. Cl.[2] ..... D03C 3/16; D03C 3/06

[52] U.S. Cl. ..... 139/59; 139/65; 139/317; 139/331

[58] Field of Search ..... 139/59–65, 139/85, 317, 331

[56] References Cited

U.S. PATENT DOCUMENTS 748,028 12/1903 Szczepanik ..... 139/331

2,103,814 12/1937 Foster ..... 139/317

FOREIGN PATENT DOCUMENTS 13,377 of 1907 Great Britain ..... 139/59

*Primary Examiner*—James Kee Chi

*Attorney, Agent, or Firm*—Kenyon & Kenyon, Reilly, Carr & Chapin

[57] ABSTRACT

The jacquard needles are moved lengthwise via a reciprocable drive element and a selector in order to selectively press the lifting wires in a pressing direction. Each needle carries a force accumulator, such as a coiled spring, which abuts against the drive element and allows the drive element to move in the pressing direction when a given needle is not to be moved. Each needle is also locked to the drive element to move with the drive element in a direction opposite the pressing direction.

9 Claims, 11 Drawing Figures

2
4
5
6
11
12
13
14
15
16
21
22
23
24
25
26
27
28
29
32
33
34
35
36
37
38
39
41
42
41a
42a
27a
28a
Y

JACQUARD MACHINE HAVING MEANS FOR CONTROLLING JACQUARD NEEDLE MOTION

This invention relates to a jacquard machine having means for controlling jacquard needle motion.

As is known, jacquard machines have been used for controlling the warp yarns in weaving machines in order to obtain variously patterned fabrics. In such machines, lifting wires are usually secured to the warp yarns to raise and lower the yarns. In addition, some of these machines have employed a reciprocal drive element for moving jacquard needles into engagement with the lifting wires in order to press the wires into a position to be raised or lowered via reciprocating griffes. Also, a selector is usually provided for selecting the jacquard needles to be moved in accordance with a pattern program.

In one such known jacquard machine, such as described in German Pat. No. 663,494, the jacquard needle ends which are near the driving element extend freely into a bore in the driving element. A magnetic selector is also disposed in the drive element after the bore for in-operation selection of each needle to be pressed. In other known machines of this kind as disclosed by German Auslegeschrift No. 1,109,105, a reader is provided between the driving element and the jacquard needle and transmits thereto the control motions instructed by a selector in accordance with a pattern.

In both the known machines, the jacquard needles are returned to their initial position after pressing solely by resilience, e.g. by the resilience of the associated lifting wire or by a special jacquard needle spring. However, a return motion based purely on resilience is unsatisfactory for the high speed of e.g. 400 or 500 movements per minute or more) of modern weaving machines.

Accordingly, it is an object of the invention to provide a jacquard needle control which is capable of efficient use in high speed weaving machines.

It is another object of the invention to avoid any need to rely on the resilience of a jacquard needle controlling the positions of lifting wires.

It is another object of the invention to provide a jacquard machine which is of relatively simple construction.

Briefly, the invention relates to a jacquard machine for controlling warp yarns in a weaving machine. The jacquard machine includes a plurality of reciprocally mounted griffes and lifting wires for engaging with respective ones of the griffes and which are secured to the warp yarns as is known. In addition, the jacquard machine comprises a reciprocable drive element, a plurality of jacquard needles and force accumulators and a selector. The needles extend longitudinally from the drive element in a pressing direction and each engages a lifting wire for pressing the wire in the pressing direction into a position to be engaged with a respective griffe. Each needle is also secured to the drive element for movement therewith in a direction opposite the pressing direction. Each force accumulator is disposed between the drive element and a respective needle to permit relative movement between the needle and drive element in the pressing direction. The selector serves to select the jacquard needles to be moved in the pressing direction.

Because of the positive locking which is provided in one direction, the jacquard needles are returned to their initial position after pressing by the pull of the drive element. Thus, because of the positively controlled motion, the jacquard machine can operate at high speeds.

In one advantageous embodiment, a bearing sleeve is secured in the drive element against longitudinal movement and is disposed between a respective needle and the drive element. In addition, a force accumulator bears on the sleeve. Each sleeve and associated force accumulator and needle are sized so as to be readily removed from the drive element and replaced.

In order to positively lock the needles to the drive element, use is made of a plurality of stop means; each stop means being disposed between a needle and the drive element to lock the needle to the drive element for movement in a direction opposite to the pressing direction.

In addition, the needles may be rotatable with the drive element to permit coupling pins on the needles to be moved into or out of engagement with lifting wires. In this case, the needles may have a flat section for engaging in a pair of sliding members which have keyhole shaped apertures through which the flat needle sections extend. When the sliding members close, the needles are prevented from rotation whereas when the sliding means open, the needles are free to rotate. Alternatively, the drive element may be in the form of a hollow grate and the sleeve about each needle formed with lugs to abut against the interior of one side wall of the grate and a lug to engage in a slot in another side wall of the grate.

These and other objects and advantages of the invention will become more apparent from the following detailed description and appended claims taken in conjunction with the accompanying drawings in which:

Figure 1:
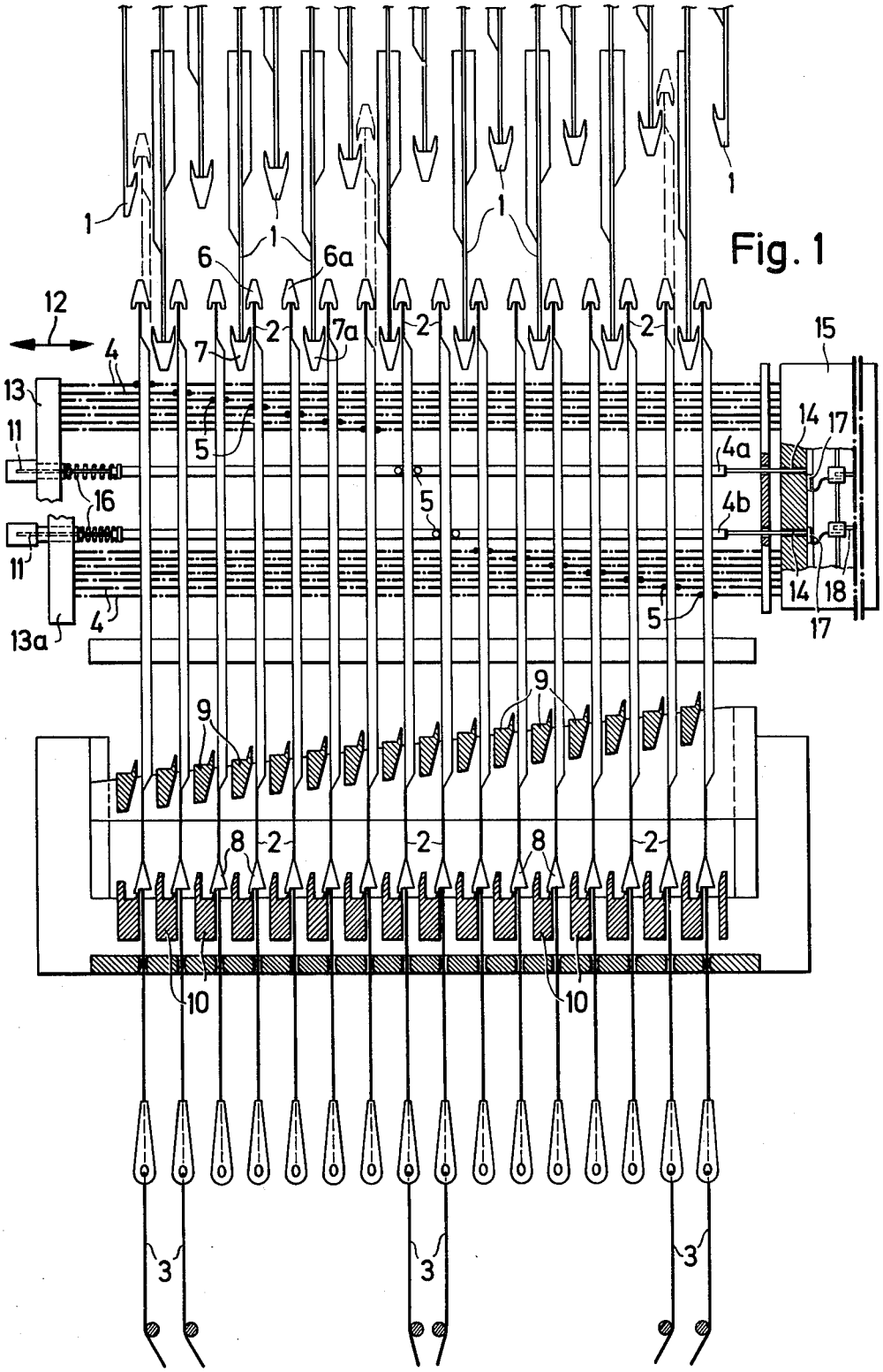
FIG. 1 illustrates a partly sectioned view in side elevation of the main parts of a jacquard machine according to the invention.

Referring to FIG. 1, the double-lift open-shed jacquard machine shown comprises a plurality of vertically reciprocally mounted griffes 1 and a plurality of lifting wires 2 adapted to be coupled with the griffes 1. Secured to the wires 2 in known manner are harness cords 3 for guiding warp yarns (not shown) of an associated weaving machine in top and bottom shed positions.

A plurality of jacquard needles 4 are also disposed in the machine with each needle 4 associated with a respective lifting wire 2. Only two jacquard needles **4*a*, 4*b* are shown, to an enlarged scale, in FIG. 1. Each needle engages by way of two coupling pins 5 with the associated lifting wire 2, so that when the jacquard needle 4 moves in FIG. 1, the associated lifting wire 2 is pressed from left to right and, e.g. has an associated hook 6 disengaged from a hook 7 of a griffe 1 or has a hook 6***a* engaged in a hook 7*a* of another griffe (disengagement or engagement). The pressing of the lifting wire 2 by means of the jacquard needles 4 is responsible for engaging and disengaging hooks 8 at the bottom of the wires 2 in top stationary stop members 9 or in bottom stationary stop members 10, respectively.

A drive element such as a grate 13 is reciprocable in the direction indicated by arrow 12 and is provided at one end — the left-hand end in the drawings — 11 of the jacquard needles 4, while at the other end — i.e. the right-hand end 14 — of the jacquard needles 4 there is a selector 15. The grate 13 has the jacquard needles 4 mounted therein so as to extend longitudinally thereof in a pressing direction. As indicated, each needle 4 engages a wire 2 for pressing the wire 2 in the pressing direction into a position to be engaged with a griffe 1. Each needle 4 is also secured to the grate 13 for movement therewith in a direction opposite the pressing direction. The selector 15 serves to select the needles 4 to be moved in the pressing direction.

In addition, a plurality of force accumulators, such as coiled compression springs 16, are disposed between the grate 13 and each needle 4 to permit relative movement between the needles 4 and the grate 13. As shown in FIG. 1, the grate is illustrated in a right-hand position 13*a* in which the jacquard needle 4*b* experiences the increased pressure of a spring 16. The needle 4*a* cannot move to the right at this time since a slider 17 of the selector 15 blocks the right-hand end 14. This slider 17 is controlled in a known manner by a multimorph bending element 18 in accordance with a pattern program.

The jacquard needles 4 are so mounted at their two ends in the grate 13 and selector 15 as to be movable only longitudinally and to be incapable of moving transversely of their length.

Figures 2, 3:
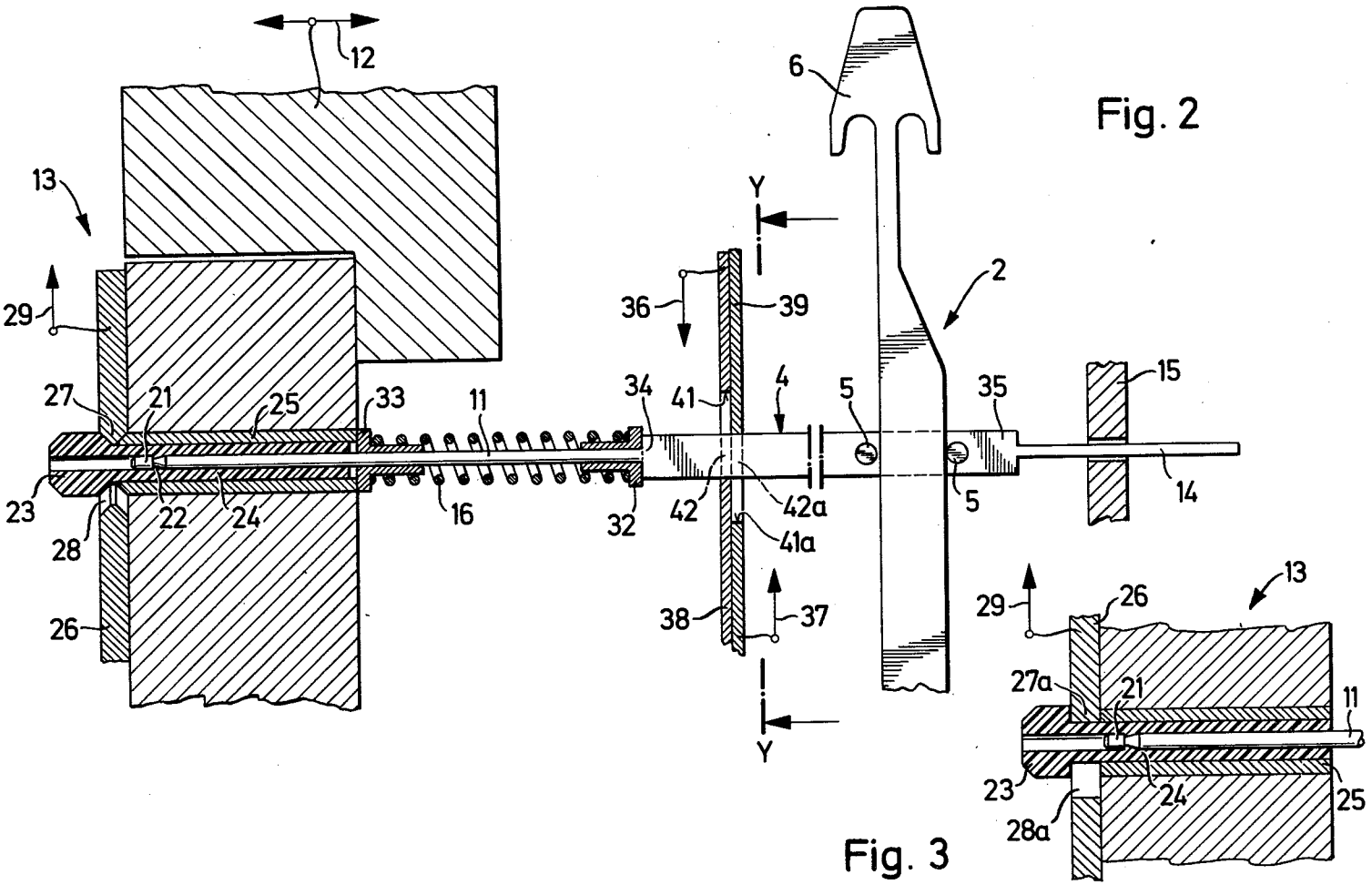
FIG. 2 illustrates a view in section of a first form of mounting for the jacquard needles of FIG. 1 in accordance with the invention.
FIG. 3 illustrates a cross-sectional view of a modified stop means of the invention.

Referring to FIG. 2, the left-hand end 11 of each jacquard needle 4 has a head 21 formed with a step or shoulder or the like 22. A sleeve 24, for example of plastics, having a widened head 23 is pushed onto the end 11 of the needle 4, i.e. onto the head 21 and step 22 and is seated in a bearing sleeve 25 in such a way that relative to sleeve 25 axial displacement to the left is possible. The bearing sleeve 25 is pushed into the grate 13 and is locked positively against horizontal movement by a stop means in the form of a vertically reciprocable locking plate 26 mounted on the grate 13 which engages in the locking position shown, by way of a pointed tip 27 in a matching recess formed between the sleeve 25 and the head 23. The stop means 26 is also disposed between the needle 4 and grate 13 to lock the needle 4 to the grate 13 for movement therewith in a direction opposite the pressing direction. The plate 26 is formed with a recess 28 so as to be able, if necessary, to be moved upwards in the direction indicated by an arrow 29 into an open position to permit withdrawal of the sleeve 25.

As shown in FIG. 2, each compression spring 16 is pushed onto a needle end 11 and bears at the ends on two slidably mounted flanges collars 32, 33. One collar 33 bears on the sleeve 25 while the other collar 32 fits about a cylindrical portion of the needle 4 and bears on a shoulder 34 of the needle 4. The spring 16 tends to move the needle 4 to the right in FIG. 2.

Figure 6:
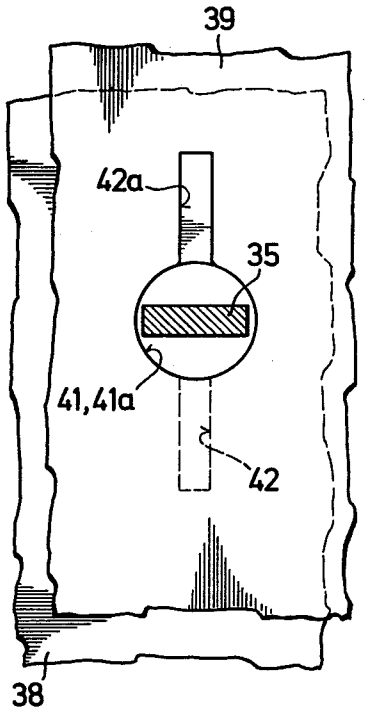
FIGS. 4 to 6 are each a view, in various positions, taken in the direction Y in FIG. 2 of a pair of sliding members for locking a needle against rotation in accordance with the invention.
Figure 5:
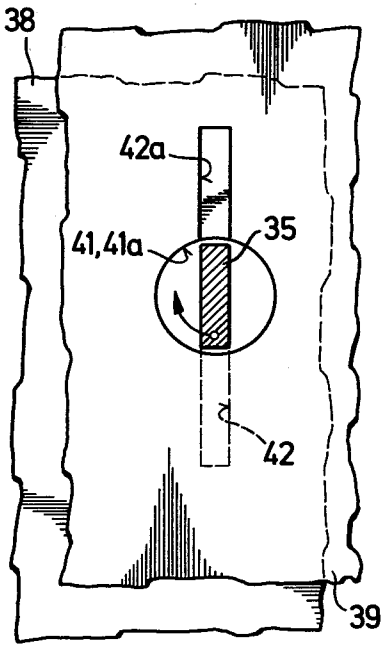
Figure 4:
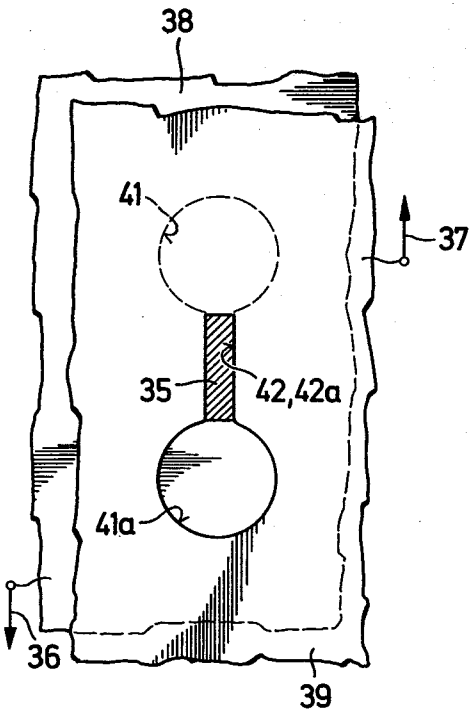

The needle 4 has a flat bar-like section 35 between the ends 11, 14 which is guided by two sliding members 38, 39 which are movable as indicated by arrows 36, 37. Each of the sliding members 38, 39 is disposed about the flat section 35 and has a key-hole shaped aperture formed by a circular recess 41, 41*a* with a recess 42, 42*a* through which the flat section 35 passes and is engaged against rotation (FIG. 4). As shown in FIGS. 5 and 6, the sliding members 38, 39 are movable relative to the needle 4 to disengage therefrom (FIG. 5) and to permit rotation of the needle 4 into a position in which the coupling pins 5 disengage from the lifting wire (FIG. 6). As shown in FIGS. 4 and 5, the recesses 42, 42*a* are sized to slidably receive the flat section 35 of a needle 4.

In operation, in order to move a needle 4 in the pressing direction, the associated slider 17 of the selector 15 is moved out of the path of the needle 4. Next, the grate 13 is moved, e.g. to the right in FIG. 2. At this time, the grate 13 carries the sleeve 24 as well as the sleeve 25 and the needle 4 via the flanged collars 33, 32 and the spring 16 to the right. The coupling pins 5 on the needle 4, thus, moves a lifting wire 2. If the needle 4 is not to be moved, the associated slider 17 is moved into the path of the needle 4. Next, as the grate 13 is moved to the right, the grate 13 slides along the sleeve 24 via the bearing sleeve 25 and comprises the spring 16 via the plate 29, sleeve 25 and flanged collar 33 (FIG. 2).

To replace a jacquard needle 4, the plate 26 is moved upwards in FIG. 2, member 38 is moved downwards and member 39 is moved upwards (position shown in FIGS. 5 and 6). The needle 4 can then be turned through 90° from the FIG. 5 position into the FIG. 6 position. Thereafter, the pins 5 are no longer in engagement with the lifting wire 2. The elements 4, 16, 32, 33, 23 - 25 can now be withdrawn as a unit to the left in FIG. 2 and all or some of them replaced. The procedure for refitting is the converse.

Referring to FIG. 3, wherein like reference characters indicate like parts as above, the recess 27*a* in the plate 26 is made rectangular and the recess 28*a* matches the shape of the recess 27*a*.

Figures 7, 8, 9:
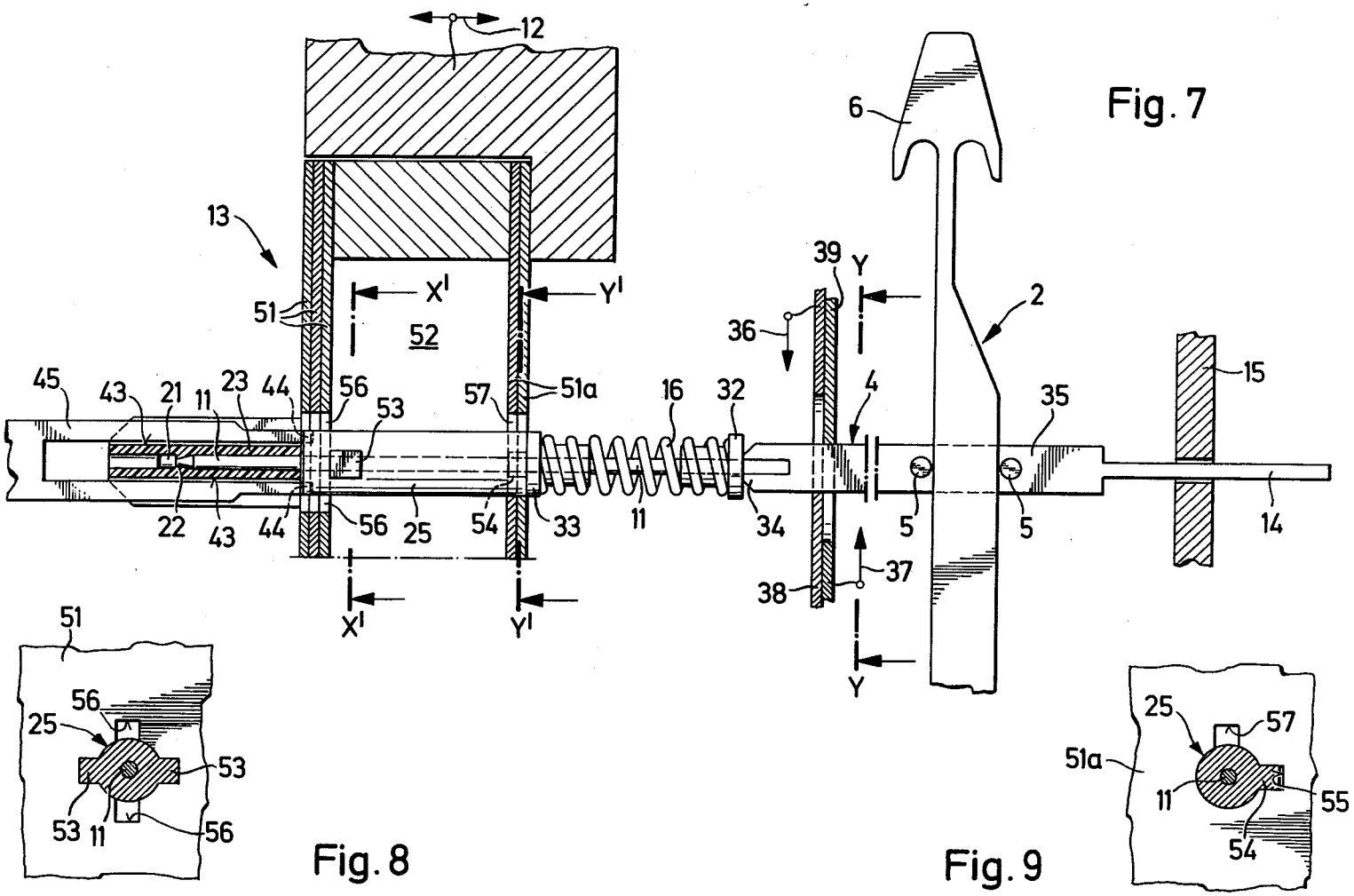
FIG. 7 illustrates a view in section of another variant of a mounting of a jacquard needle in accordance with the invention.
FIGS. 8 and 9 are views looking in the directions X' and Y' respectively in FIG. 7.

Referring to FIG. 7, wherein like reference characters indicate like parts as above, the drive element may be formed as a hollow grate 13 with two opposite side walls formed of plate elements 51, 51*a* to define a space 52. The grate 13 is thus of reduced weight. The side walls 51, 51*a* are apertured to permit passage of a needle 4. In this embodiment, the bearing sleeve 25 has two oppositely disposed lugs 53 (FIG. 8) within the space 52 of the grate 13 abutting the wall 51 to selectively lock the sleeve 25 and needle 4 against movement to the left as viewed. As shown in FIG. 8, the aperture in the sidewall 51 has two opposed grooves 56 to allow passage of the lugs 53. The bearing sleeve 25 also has a third lug 54 engaged in the opposite wall 51*a* (FIG. 9) to selectively lock the sleeve 25 and needle 4 against rotation in the grate 13. As shown in FIG. 9, the aperture in the sidewall 51*a* has two grooves 55, 57 to selectively receive the lug 54.

Referring to FIG. 7, the sleeve 23 has a pair of radial grooves or notches 43 in the bearing sleeve 25.

For removal, a tool 45 is introduced into the grooves 43 of the sleeve 23 and into the grooves 44 of the sleeve 25. This latter is pressed to the right in FIG. 7 until the lug 54 disengages from the groove 55. Thereafter, the tool 45 and the sleeves 23, 25 are turned through 90°. The lugs 53 then engage in the grooves 56 in the wall 51 and the lug 54 engages in the groove 57 in the wall 51*a*.

A leftwards axial movement in FIG. 7 can now be made so that the elements 4, 16, 32, 33, 21 - 25 can be withdrawn as a unit to the left in FIG. 7.

Figure 10:
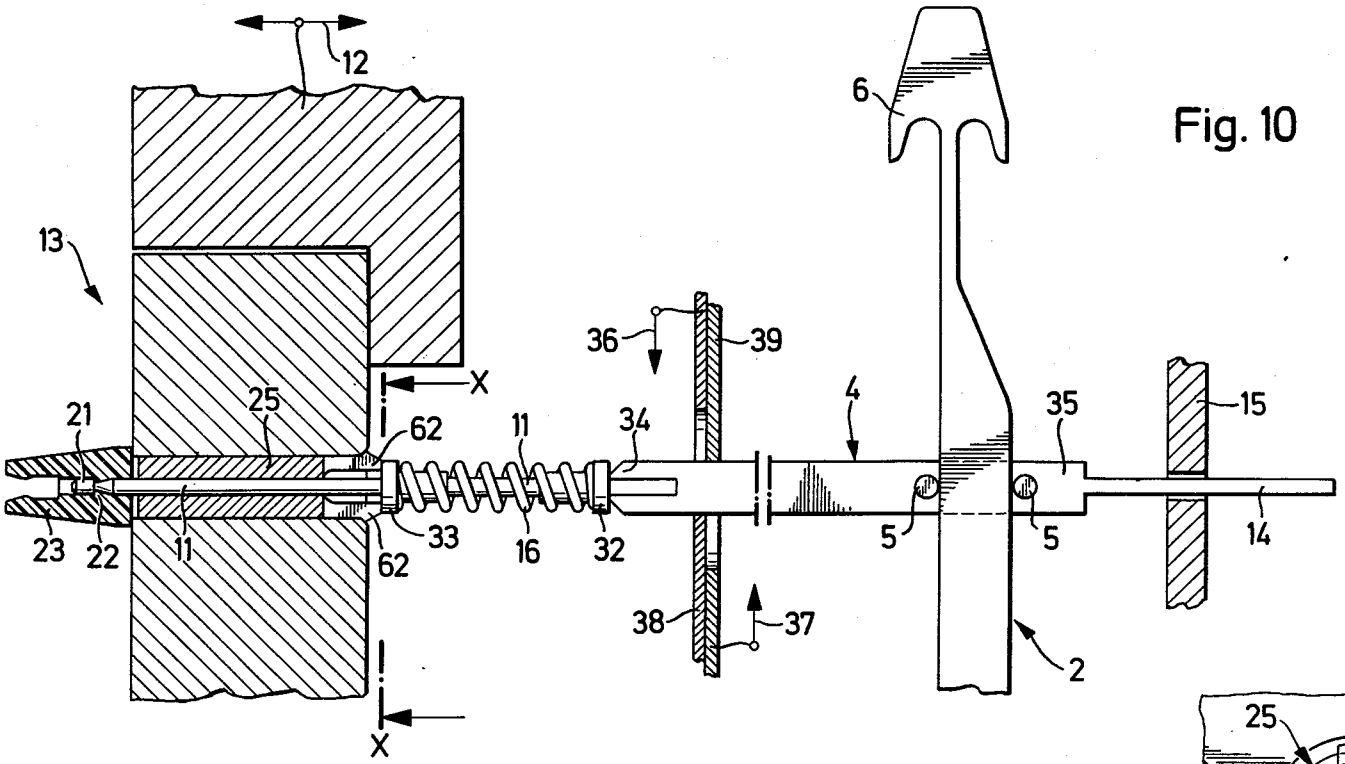
FIG. 10 illustrates a sectional view of another embodiment of a mounting of a jacquard needle in accordance with the invention.
Figure 11:
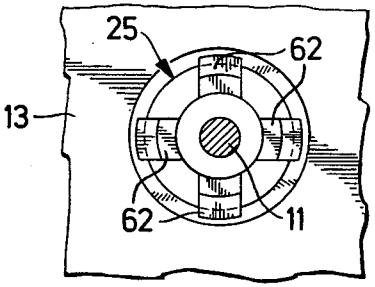
FIG. 11 illustrates a view looking in the direction X in FIG. 10.

Referring to FIGS. 10 and 11, wherein like reference characters indicate like parts as above, the sleeve 25 may be constructed with radially resilient tongues 62 in order to be poistively secured in the grate 13. A strong leftwards pull on head 23 in FIG. 10 moves the tongues 62 radially inwards so that the jacquard needle 4 and the other elements 16, 32, 33, 25 can be withdrawn to the left provided that the sliding members 38, 39 have been moved into the position shown in FIGS. 5 and 6. As also shown, the sleeve 23 is shaped to act as a stop means between the needle 4 and the grate 13 to lock the needle 4 to the grate 13 for movement to the left as viewed.

As can be gathered from the drawings, the way in which the jacquard needles 4 are mounted in the grate 13 is achieved more particularly because the selector 15 is disposed at one end 14 of the jacquard needles 4 while the opposite end 11 of the jacquard needles 4 are fixedly mounted in the grate 13 without any vertical movement of the end 11 being necessary, e.g. in FIGS. 2, 4, 7 and 10. In known machines, vertical movements are required since the ends 11 must be raised by a selector, e.g. by a jacquard cylinder having sensing needles disposed on the side of the grate 13 and must then be movable to the right by the grate. If the jacquard needle 4 is not moved to the right in this known machine, the end 11 remains in a bottom position in which it cannot be engaged by the grate 13.

The selector for the machine can be constructed as a jacquard cylinder 15 sensed by the ends 14. The selector can also be disposed to the left of the grate 13 in FIG. 1. In this event, the jacquard needles are continued to the left through the grate 13 where they cooperate with the selector.

What is claimed is:

1. A jacquard machine for controlling warp yarns in a weaving machine comprising a plurality of reciprocally mounted griffes;

a plurality of lifting wires for engaging with respective ones of said griffes;

a reciprocable drive element;

a plurality of jacquard needles extending longitudinally thereof from said drive element in a pressing direction, each said needle engaging a respective lifting wire for pressing said wire in said pressing direction into a position to be engaged with a respective griffe, each said needle being rotatably secured to said drive element for movement therewith in a direction opposite said pressing direction and having coupling pins engaging a respective wire and a flat section;

a pair of sliding members disposed about each flat section of a respective needle, each sliding member having a key-hole shaped aperture through which a flat section of a respective needle passes and is engaged against rotation, said sliding members being movable relative to said respective needle to disengage therefrom and to permit rotation of said needle into a position in which said pins thereof disengage from said respective lifting wires;

a plurality of force accumulators, each said force accumulator being disposed between said drive element and a respective needle to permit relative movement between said respective needle and said drive element in said pressing direction; and a selector for selecting the jacquard needles to be moved in said pressing direction.

2. A jacquard machine as set forth in claim 1 which further comprises a plurality of bearing sleeves fixedly mounted in said drive element, each said bearing sleeve having a respective needle slidably mounted therein and having a respective force accumulator bearing thereon.

3. A jacquard machine comprising a plurality of lifting wires;

a reciprocable drive element;

a plurality of jacquard needles extending in parallel relation from said drive element in a given pressing direction, each said needle being engageable with a respective lifting wire for pressing said wire in said pressing direction, each said needle being slidably mounted within said drive element;

a plurality of force accumulators, each said accumulator being disposed between said drive element and a respective needle to permit relative movement between said needle and said drive element during movement of said drive element in said pressing direction;

a plurality of stop means, each said stop means being disposed between a respective needle and said drive element to lock said needle to said drive element for movement therewith in a direction opposite said pressing direction; and a selector for selecting the jacquard needles to be moved in said pressing direction.

4. A jacquard machine as set forth in claim 3 which further comprises a plurality of bearing sleeves fixedly mounted in said drive element, each said bearing sleeve having a respective needle slidably mounted therein and having a respective force accumulator bearing thereon at one end with a respective stop means engaging therewith at the opposite end.

5. A jacquard machine as set forth in claim 4 wherein each said sleeve and respective force accumulator are of the same exterior size for withdrawing through said drive element in a direction opposite said pressing direction upon removal of the respective stop means from said needle.

6. A jacquard machine as set forth in claim 4 wherein each said sleeve has radially resilient tongues at one end engaging against said drive element to fixedly secure said sleeve in said drive element.

7. A jacquard machine as set forth in claim 3 wherein said drive element is a hollow grate having a pair of apertured side walls and each sleeve is fixed to a respective needle and has two lugs within said grate abutting one of said walls to selectively lock said sleeve against movement in said opposite direction and a third leg engaged in said other wall to selectively lock said sleeve against rotation in said grate.

8. A jacquard machine for controlling warp yarns in a weaving machine comprising a plurality of reciprocally mounted griffes;

a plurality of lifting wires for engaging with respective ones of said griffes;

a reciprocable drive element;

a plurality of jacquard needles extending longitudinally thereof from said drive element in a pressing direction, each said needle engaging a respective lifting wire for pressing said wire in said pressing direction into a position to be engaged with a respective griffe;

a plurality of force accumulators, each said force accumulator being disposed between said drive element and a respective needle to permit relative movement between said respective needle and said drive element in said pressing direction;

a selector for selecting the jacquard needles to be moved in said pressing direction; and a plurality of stop means, each said stop means being disposed between a respective needle and said drive element to lock said needle to said drive element for movement therewith in a direction opposite said pressing direction while allowing said drive element to move relative to said needle against a respective force accumulator in said pressing direction.

9. A jacquard machine as set forth in claim 8 wherein each said stop means is movably mounted on said drive element to permit withdrawal of a respective needle from said drive element.

* * * * *